US005429296A

United States Patent [19]

Southwell et al.

[11] Patent Number: 5,429,296

[45] Date of Patent: Jul. 4, 1995

[54] STACKABLE BERRY CONTAINER

[75] Inventors: James D. Southwell, Palatine; Victor R. Rioux, Buffalo Grove, both of Ill.; Jeanne M. O'Malley, Long Beach, Calif.

[73] Assignee: Packaging Corporation of America, Evanston, Ill.

[21] Appl. No.: 340,626

[22] Filed: Nov. 16, 1994

[51] Int. Cl.[6] ..... B65D 5/22

[52] U.S. Cl. ..... 229/168; 229/120; 229/178; 229/916; 229/919

[58] Field of Search ..... 229/120, 167, 168, 178, 229/915, 916, 919

[56] References Cited

U.S. PATENT DOCUMENTS

| | | | |
|---|---|---|---|
| 2,965,279 | 12/1960 | Campbell | 229/178 |
| 3,074,615 | 1/1963 | Johnson | 229/167 |
| 3,102,674 | 9/1963 | Hamilton | 229/120 |
| 3,375,967 | 4/1968 | Robinson | 229/178 |
| 3,533,547 | 10/1970 | Houston | 229/120 |
| 3,887,126 | 6/1975 | Wilson | 229/178 |
| 4,770,339 | 9/1988 | Weiner | 229/120 |

FOREIGN PATENT DOCUMENTS

| | | | |
|---|---|---|---|
| 1192575 | 10/1959 | France | 229/167 |
| 1427904 | 1/1966 | France | 229/167 |
| 2611652 | 9/1988 | France . | |
| 3110533 | 10/1982 | Germany | 229/915 |
| 1105298 | 3/1968 | United Kingdom | 229/178 |
| 2085405 | 4/1982 | United Kingdom | 229/178 |

*Primary Examiner*—Gary E. Elkins
*Attorney, Agent, or Firm*—Arnold, White & Durkee

[57] ABSTRACT

A stackable berry container comprises a bottom wall, a pair of opposing side walls, and first and second opposing end walls. Each of the first and second end walls forms a respective set of small vents spaced along the lengths of the end walls adjacent the bottom wall. Each of the first and second end walls further forms a respective large opening above the respective set of small vents. Each of the first and second end walls includes a bowed inner panel and an outer panel hingedly connected to each other along a rigid convex-shaped ledge. Each of the side walls including an inner panel and an outer panel hingedly connected to each other along an upper transverse edge. A first pair of minor flaps extends from opposing ends of the inner panel of one of the side walls and a second pair of minor flaps extends from opposing ends of the inner panel of the other of the side walls. One of the first pair of flaps and one of the second pair of flaps are captured between the inner and outer panels of the first end wall. The other of the first pair of flaps and the other of the second pair of flaps are captured between the inner and outer panels of the second end wall.

14 Claims, 4 Drawing Sheets

STACKABLE BERRY CONTAINER

FIELD OF THE INVENTION

The present invention relates generally to berry containers. More particularly, the present invention relates to a stackable berry container with improved structural rigidity.

BACKGROUND OF THE INVENTION

On berry ranches, harvested berries are typically first placed in ventilated primary plastic containers. These filled primary plastic containers are then placed in a secondary box or container. The secondary container typically includes a bottom wall, a pair of opposing side walls, and a pair of opposing end walls. After loading a given number of the filled primary containers into the secondary container, the secondary container is loaded onto a pallet. The process of filling primary plastic containers, loading a given number of the primary containers into a secondary container, and loading the secondary container onto the pallet is repeated until the pallet supports a predetermined number (e.g., 96) of secondary containers. The secondary containers are typically arranged on the pallet in multiple stacks. For example, if the pallet supports 96 secondary containers and the dimensions of the pallet are sufficiently large to accommodate six secondary containers per layer, the secondary containers may be arranged in six stacks with 16 secondary containers in each stack.

After the predetermined number of secondary berry containers are loaded onto the pallet, the loaded pallet is moved to a refrigeration unit to cool the berries. Since the refrigeration unit has a limited capacity, it is important that both the primary and secondary berry containers be designed for optimal cooling efficiency. To optimize cooling efficiency, both the primary and secondary berry containers are provided with strategically positioned cooling vents. Cool air from the refrigeration unit is forced through the vents in both the primary and secondary berry containers. The vents in the secondary berry container are designed to generate turbulence within the secondary container, thereby assuring cold air flow through and around all portions of the berry-filled primary containers.

To promote optimal cooling efficiency, which in turn enhances berry quality and shelf life, each end wall of the secondary container may be provided with a large opening. Cool air from the refrigeration unit flows through the secondary berry container via the large openings in the end walls thereof. Since the cooling speed is proportional to the amount of cool air flowing through the secondary berry container, it is desirable to maximize the size of the opening in the end walls of the secondary container. Increasing the size of the openings, however, compromises the structural rigidity of the secondary container. The secondary berry container must provide torsional and flexural rigidity in order to exhibit superior stacking performance. Without structural rigidity, containers at or near the bottom of a stack could buckle under the weight of the containers stacked above them. Due to this buckling, the berries in one or more containers may either be damaged or destroyed. Furthermore, without structural rigidity, the containers could sway or vibrate, thereby causing abrasion damage to the berries.

Accordingly, a need exists for a stackable secondary berry container which provides structural rigidity while optimizing cooling efficiency.

SUMMARY OF THE INVENTION

In one particular embodiment, the present invention provides a berry container having a bottom wall, a pair of opposing side walls, and a pair of opposing end walls. Each end wall forms a respective set of small vents spaced along the length of the end wall adjacent the bottom wall. Furthermore, each end wall forms a large opening above the associated set of small vents. To enhance the structural rigidity of the container, each end wall is formed from a bowed inner panel and an outer panel hingedly connected to each other along a rigid convex-shaped ledge.

BRIEF DESCRIPTION OF THE DRAWINGS

Other objects and advantages of the invention will become apparent upon reading the following detailed description and upon reference to the drawings in which.

Figure 1:
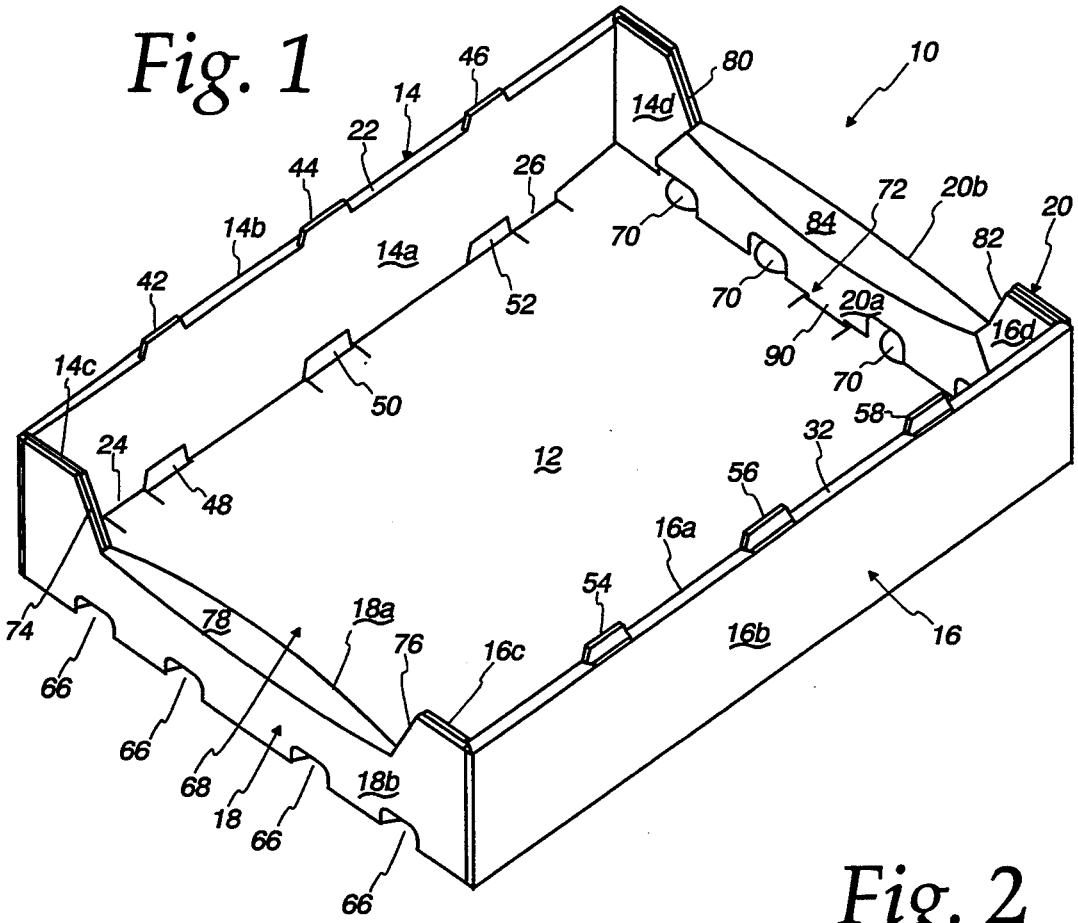
FIG. 1 is a perspective view of a stackable berry container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIG. 1 illustrates a stackable berry container 10 composed of a relatively rigid material such as corrugated board, solid fiber board, heavy paperboard, or heavy plastic sheet. The berry container 10 includes a bottom wall 12, a pair of opposing side walls 14, 16, and a pair of opposing end walls 18, 20. The end walls 18, 20 form respective sets of small vents 66, 70 as well as respective large openings 68, 72. To counteract the reduction in structural rigidity caused by the large openings 68, 72, the end wall 18 is formed from a bowed inner panel **18*a* and an outer panel 18*b* hingedly connected to each other along a convex-shaped ledge 78. Likewise, the end wall 20 is formed from a bowed inner panel 20*a* and an outer panel 20*b* hingedly connected to each other along a convex-shaped ledge 84. As described in detail below, the bowed inner panels 18*a*, 20*a* and the convex-shaped ledges 78, 84 provide the berry container 10** with enhanced structural rigidity.

To enhance the rigidity of the side walls 14, 16, each side wall is formed from a pair of parallel panels. In particular, the side wall 14 is formed from inner and outer panels **14*a*, 14*b* hingedly connected to each other along an upper transverse edge 22 of the side wall 14**.

Figure 4:
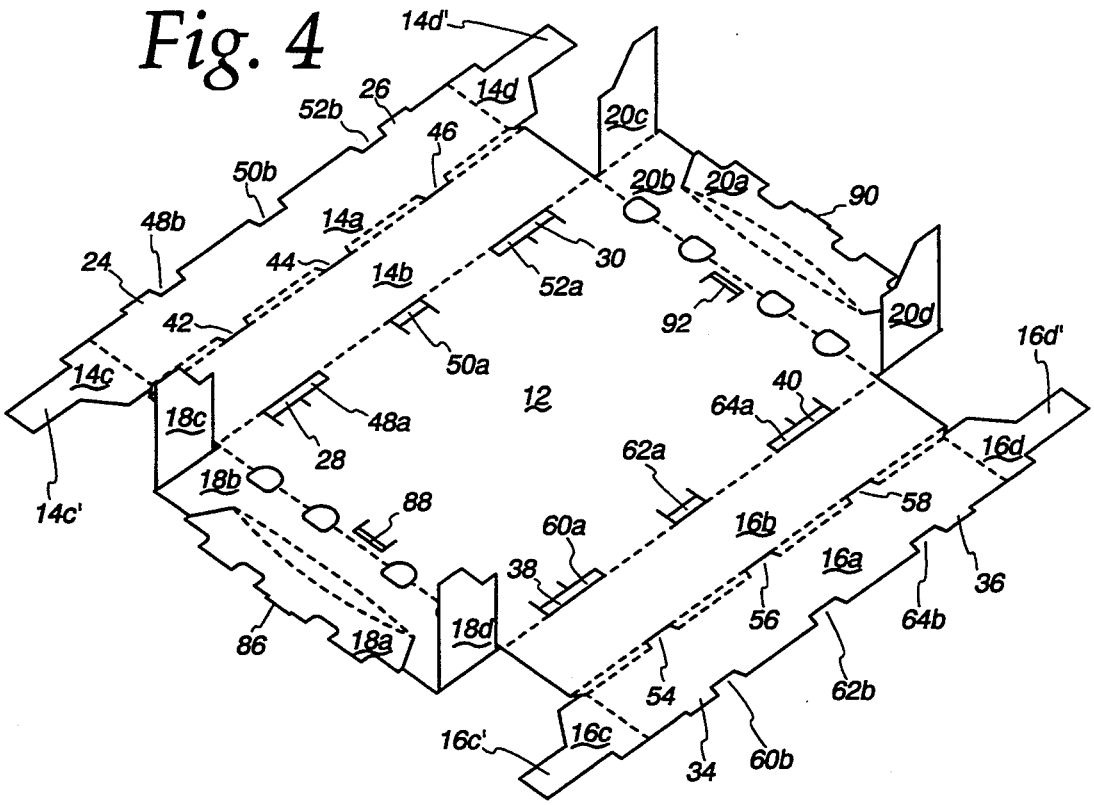
FIGS. 4 through 7 are perspective views illustrating the sequence in which the panels of the blank in FIG. 3 are folded to form the berry container in FIG. 1.

The outer panel 14b is hingedly connected with the bottom wall 12, and the inner panel 14a is detachably connected to the bottom wall 12 by means of a pair of locking tabs 24, 26 which interlock with a corresponding pair of locking slots 28, 30 in the bottom wall 12 (FIG. 4). Similarly, the side wall 16 is formed from inner and outer panels 16a, 16b hingedly connected to each other along an upper transverse edge 32 of the side wall 16. The outer panel 16b is hingedly connected to the bottom wall 12, and the inner panel 16a is detachably connected to the bottom wall 12 by means of a pair of locking tabs 34, 36 which interlock with a corresponding pair of locking slots 38, 40 in the bottom wall 12 (FIG. 4).

To permit stacking of several identical berry containers 10 in a reliable, stable, and balanced manner, the berry container 10 is provided with a plurality of stacking tabs and a plurality of stacking slots. In a preferred embodiment, three stacking tabs 42, 44, and 46 extend upwardly from the upper transverse edge 22 of the side wall 14, and three stacking tabs 54, 56, and 58 extend upwardly from the upper transverse edge 32 of the side wall 16. When an identical berry container is stacked on top of the berry container 10, the stacking tabs 42, 44, and 46 are received by slots akin to the slots 48, 50, and 52 of the berry container 10, and the stacking tabs 54, 56, and 58 are received by slots akin to the slots 60, 62, and 64 (FIG. 4).

As shown in FIG. 4, the stacking slots 48, 50, and 52 include respective first portions 48a, 50a, and 52a in the bottom wall 12 and respective second portions 48b, 50b, and 52b at the lower transverse edge of the inner panel 14a of the side wall 14. The first slot portions 48a, 52a are open to the respective slots 28, 30 used for locking the respective tabs 24, 26. The configurations of the second slot portions 48b, 50b, and 52b correspond to the configurations of the respective stacking tabs 42, 44, and 46. Similarly, the stacking slots 60, 62, and 64 include respective first portions 60a, 62a, and 64a in the bottom wall 12 and respective second portions 60b, 62b, and 64b at the lower transverse edge of the inner panel 16a of the side wall 16. The first slot portions 60a, 64a are open to the respective slots 38, 40 used for locking the respective tabs 34, 36. The configurations of the second slot portions 60b, 62b, and 64b correspond to the configurations of the respective stacking tabs 54, 56, and 58.

When the berry container 10 is stacked on top of an identical berry container, the stacking tabs of the lower container protrude through the first portions into the second portions of the respective slots. For example, a stacking tab akin to the tab 42 of the container 10 would extend through the first portion 48a into the second portion 48b of the slot 48. Since the profile of the second slot portion 48b corresponds to the profile of the stacking tab, the stacking tab would fill the second slot portion 48b. With the second slot portions essentially plugged by the stacking tabs, the side walls 14, 16 do not contain vents permitting air to flow therethrough. As a result, in a refrigeration unit, cool air can only flow through the small vents 66, 70 and the large openings 68, 72 in the respective end walls 18, 20 of the container 10.

To optimize cooling efficiency while the berry container 10 is in a refrigeration unit, the four small vents 66 are formed at the junction between the end wall 18 and the bottom wall 12, the large opening 68 is formed by the end wall 18, the four small vents 70 are formed at the junction between the end wall 20 and the bottom wall 12, and the large opening 72 is formed by the end wall 20. The small vents 66, 70 are strategically positioned and designed such that when the container 10 is in a refrigeration unit with berry-filled primary containers disposed within the container 10, the vents 66, 70 generate turbulence within the container 10. This turbulence insures that cool air will flow through and around all portions of berry-filled primary containers disposed within the container 10. The berry-filled primary containers include multiple vents in their lids and base portions to permit the cool air to flow through these containers. In addition to generating turbulence within the container 10, the vents 66, 70 force cool air through the vents in the base portions of the primary containers because the vents 66, 70 are aligned with these base portion vents. The primary function of the large openings 68, 72 is to circulate cool air through the berry container 10 during refrigeration. The cool air enters the container 10 via one of the large openings 68, 72 and exits the container 10 via the other of the large openings 68, 72.

The large opening 68 is preferably formed with generally opposing side edges 74, 76 and the lower convex-shaped ledge 78, and is relatively large compared to the dimensions of the end wall 18. The side edges 74, 76 are disposed in close proximity to the respective side walls 16, 14 such that the large opening 68 extends substantially across the length of the end wall 18. The convex-shaped ledge 78 is disposed approximately midway between the upper and lower edges of the end wall 18 such that the large opening 68 extends approximately halfway down from the uppermost edge of the end wall 18. As the large opening 72 formed by the end wall 20 is identical to the large opening 68, it is not described in detail herein. It suffices to state that the large opening 72 is preferably formed with generally opposing side edges 80, 82 and the lower convex-shaped ledge 84. The large size of the openings 68, 72 optimizes the flow of cool air through the berry container 10 during refrigeration so as to quickly cool the berries held by primary plastic containers situated within the container 10.

In order that the large size of the openings 68, 72 in the respective end walls 18, 20 does not compromise the structural rigidity and stacking strength of the berry container 10, the container 10 includes several features which significantly enhance the rigidity and stacking strength of the container 10. First, the end wall 18 is formed from inner and outer panels 18a, 18b hingedly connected to each other along the rigid convex-shaped ledge 78. The outer panel 18b is hingedly connected with the bottom wall 12, and the inner panel 18a is detachably connected to the bottom wall 12 by means of a locking tab 86 which interlocks with a locking slot 88 in the bottom wall 12 (FIG. 4). Since the inner panel 18a is hingedly connected to the curved inner edge of the ledge 78, the inner panel 18a bows (i.e., arches or curves) inward toward the interior of the container 10. Similarly, the end wall 20 is formed from inner and outer panels 20a, 20b hingedly connected to each other along the rigid convex-shaped ledge 84. The outer panel 20b is hingedly connected to the bottom wall 12, and the inner panel 20a is detachably connected to the bottom wall 12 by means of a locking tab 90 which interlocks with a locking slot 92 in the bottom wall 12 (FIG. 4). Since the inner panel 20a is hingedly connected to the curved inner edge of the ledge 84, the inner panel 20a bows inward toward the interior of the container 10. The bowed inner panels 18a, 20a in conjunction with the convex-shaped ledges 78, 84 significantly improve the torsional and flexural rigidity of the berry container 10, thereby improving the stacking strength of the container 10.

Figure 2:
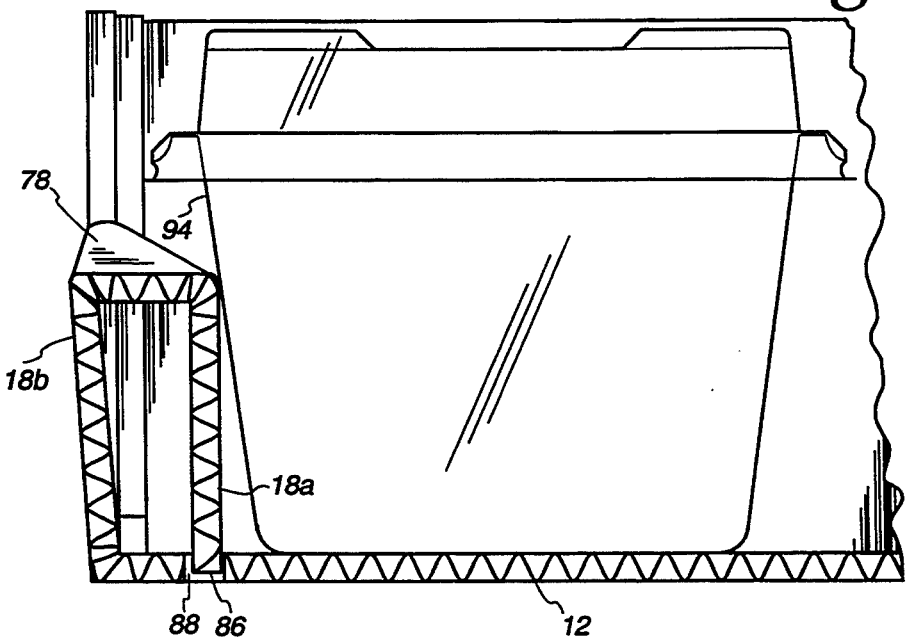
FIG. 2 is a section taken generally along line 2—2 in FIG. 1.

Moreover, the bowed inner panels 18*a*, 20*a* assist in fixing the position of the berry-filled primary containers within the container 10. The container 10 is preferably designed to hold eight berry-filled containers arranged in four rows with two containers per row. With respect to the container 10 in FIG. 1, a pair of berry-filled containers are positioned adjacent the end wall 18, a pair of berry-filled containers are positioned adjacent the end wall 20, and four berry-filled containers are positioned between the foregoing pairs of containers away from the end walls 18, 20. Since each berry-filled primary container is wider at its top (lid) than at its bottom, the primary containers adjacent the end walls 18, 20 would tend to shift in the absence of the bowed inner end wall panels 18*a*, 20*a* because the end walls 18, 20 would not support (abut) the primary containers in the area of the large openings 68, 71. The bowed inner panels 18*a*, 20*a* support (abut) lower portions of the adjacent berry-filled containers in the area of the large openings 68, 72 so as to minimize the tendency of these primary containers to shift due to unequal support. Thus, the bowed inner panels 18*a*, 20*a* prevent the berry-filled containers from shifting askew relative to the container 10. For example, as illustrated in FIG. 2, the bowed inner panel 18*a* contacts a lower portion of the adjacent primary container 94 to assist in fixing the position of the container 94 within the secondary container 10.

Another feature of the container 10 which significantly enhances its structural rigidity and stacking strength is that (1) the inner and outer panels of the end walls 18, 20 capture and secure minor flaps extending from opposing ends of the inner side wall panels 14*a*, 16*a* and (2) the inner and outer panels of the side walls 14, 16 capture and secure minor flaps extending from opposing ends of the outer end wall panels 18*b*, 20*b*. In particular, minor flaps 14*c*, 14*d* are hingedly connected to opposing ends of the inner panel 14*a* of the side wall 14, and minor flaps 16*c*, 16*d* are hingedly connected to opposing ends of the inner panel 16*a* of the side wall 16 (FIG. 4). The flaps 14*c*, 16*c* include respective narrow sections 14*c*', 16*c*' (FIG. 4) which are trapped between the inner and outer panels 18*a*, 18*b* of the end wall 18 beneath the large opening 68. Similarly, the flaps 14*d*, 16*d* include respective narrow sections 14*d*', 16*d*' (FIG. 4) which are trapped between the inner and outer panels 20*a*, 20*b* of the end wall 20 beneath the large opening 72. Furthermore, minor flaps 18*c*, 18*d* are hingedly connected to opposing ends of the outer panel 18*b* of the end wall 18, and minor flaps 20*c*, 20*d* are hingedly connected to opposing ends of the outer panel 20*b* of the end wall 20 (FIG. 4). The flaps 18*c*, 20*c* are trapped between the inner and outer panels 14*a*, 14*b* of the side wall 14, while the flaps 18*d*, 20*d* are trapped between the inner and outer panels 16*a*, 16*b* of the side wall 16. The foregoing engagement of minor flaps extending from both the side walls and end walls of the container 10 improves the structural rigidity and stacking strength of the container 10 by locking and supporting the side walls 14, 16 and end walls 18, 20 generally orthogonal to the bottom wall 12.

Figure 3:
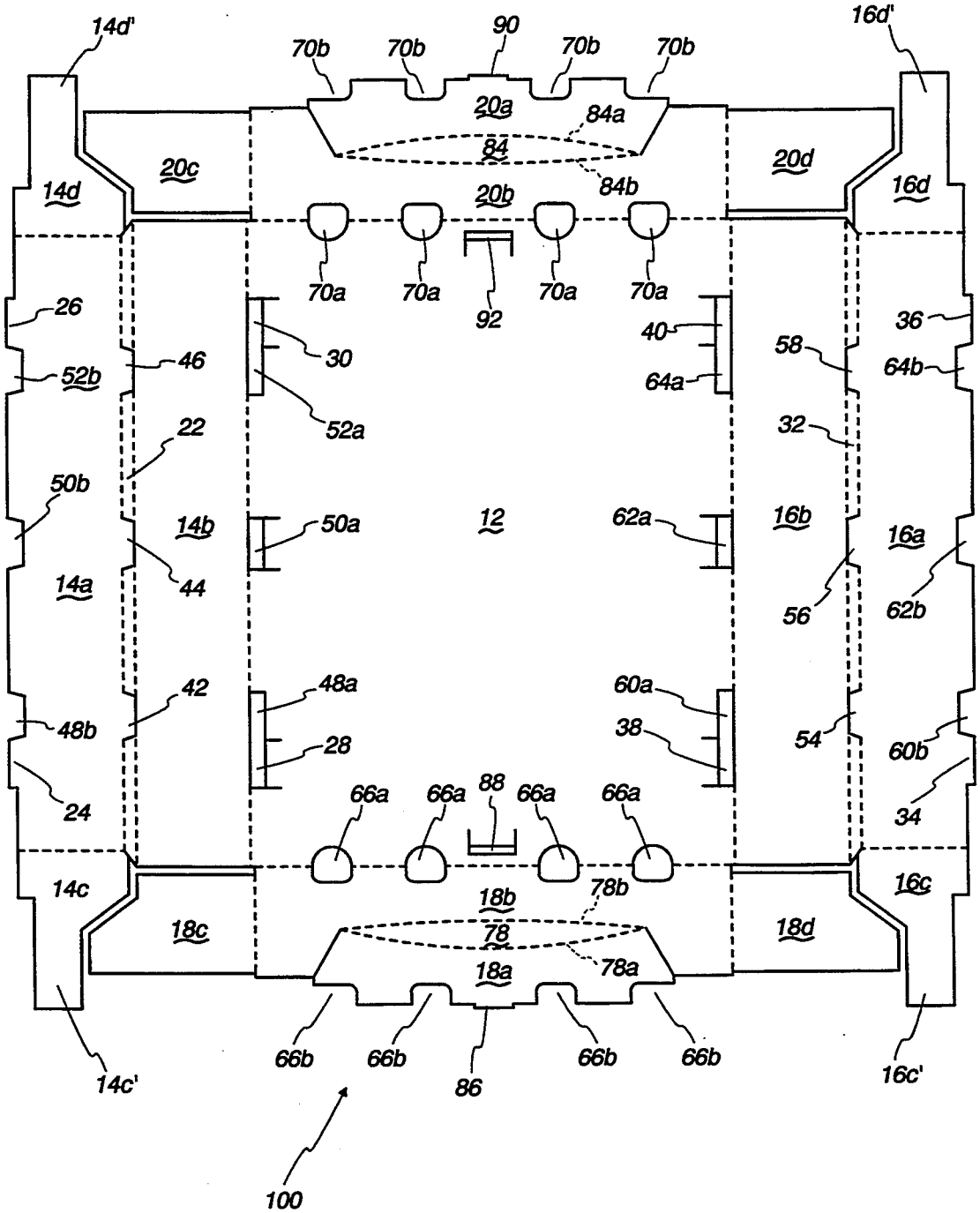
FIG. 3 is a plan view of the inner surface of a blank for forming the stackable berry container in FIG. 1.

FIG. 3 depicts a plan view of the inner surface of a blank 100 used for forming the berry container 10 in FIG. 1. As shown in FIG. 3, the container blank 100 is in the form of a planar, unitary section of rigid material such as corrugated board, solid fiber board, heavy paperboard, or heavy plastic sheet. With respect to the assembled container 10 in FIG. 1, corresponding parts are indicated by the same reference numerals.

Figure 5:
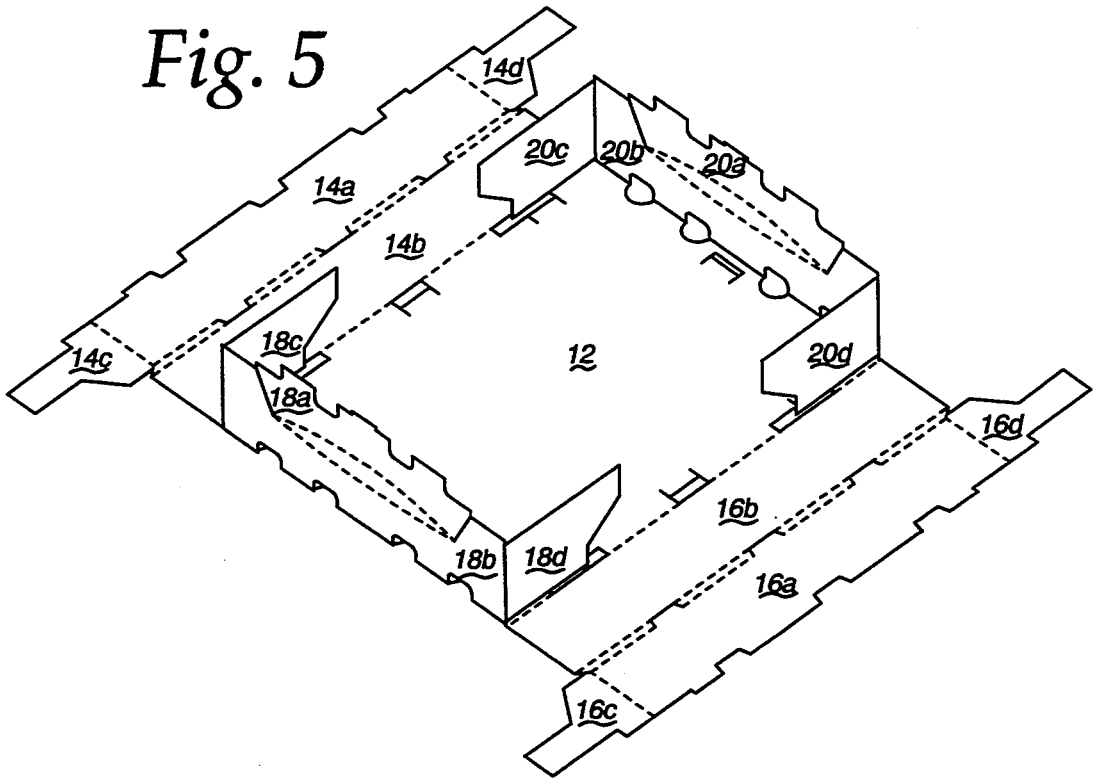
Figure 6:
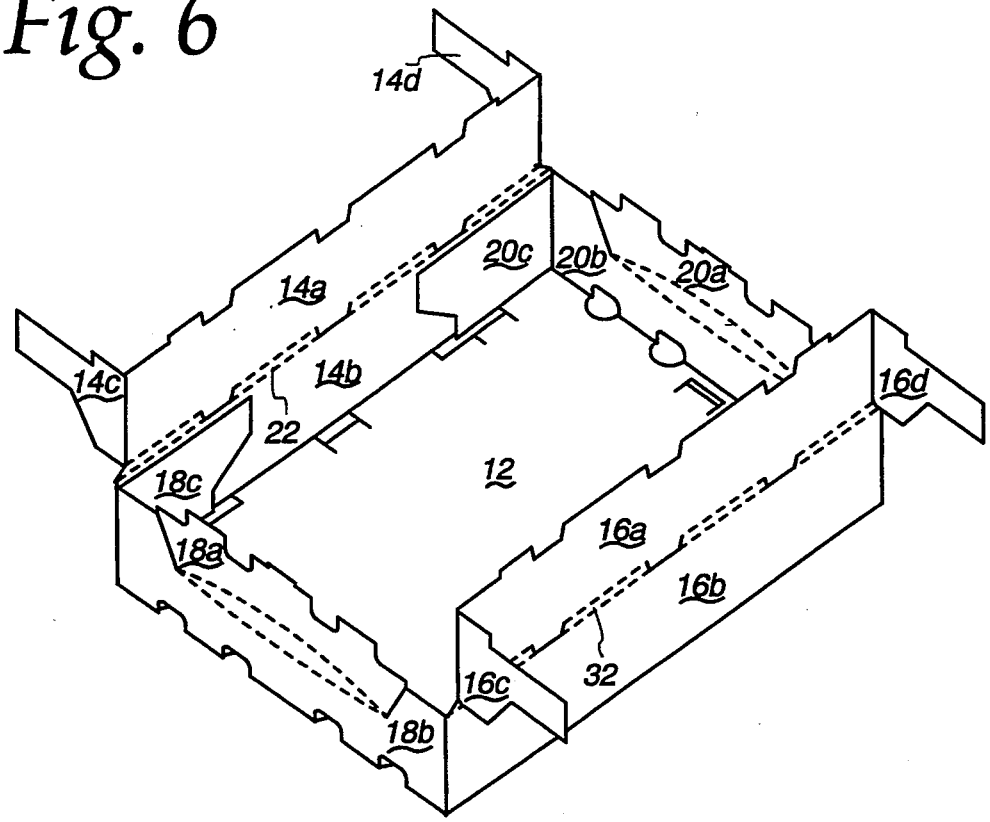

Using the sequence of folding steps detailed below, the container 10 may be formed by hand or using conventional tray-making equipment. First, as illustrated in FIG. 4, the minor flaps 18*c*, 18*d* are each rotated upward approximately 90 degrees relative to the outer end wall panel 18*b*, and the minor flaps 20*c*, 20*d* are each rotated upward approximately 90 degrees relative to the outer end wall panel 20*b*. Second, as illustrated in FIG. 5, the outer end wall panels 18*b*, 20*b* are each rotated upward approximately 90 degrees relative to the bottom wall 12 so that these panels 18*b*, 20*b* are generally parallel to each other. Third, as illustrated in FIG. 6, the minor flaps 14*c*, 14*d* are each rotated downward approximately 90 degrees relative to the inner side wall panel 14*a*, and the minor flaps 16*c*, 16*d* are each rotated downward approximately 90 degrees relative to the inner side wall panel 16*a*. Also, the outer side wall panels 14*b*, 16*b* are each rotated upward approximately 90 degrees relative to the bottom wall 12 so that these panels 14*b*, 16*b* are generally parallel to each other.

Figure 7:
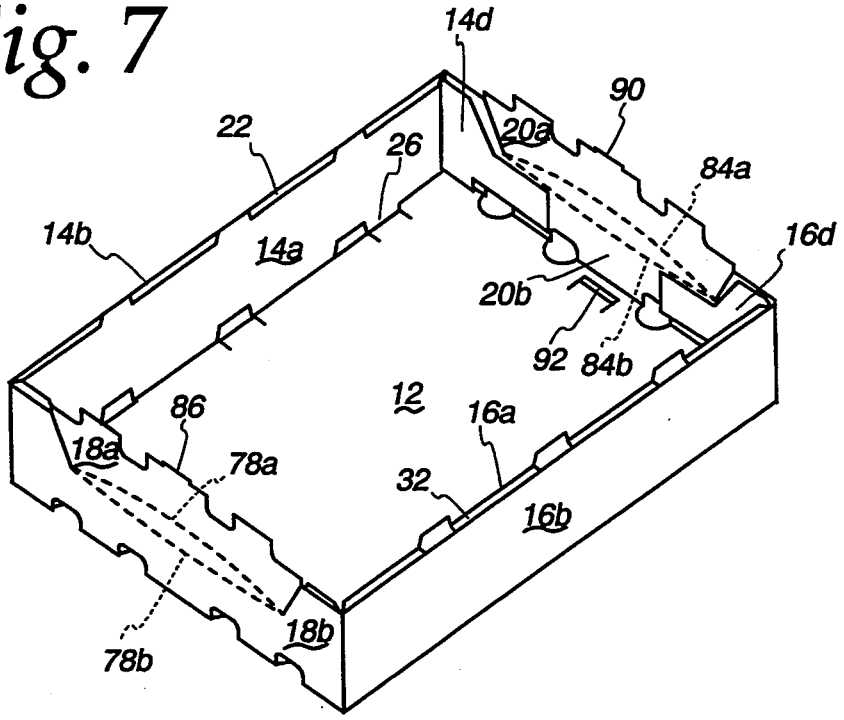

Fifth, as illustrated in FIG. 7, the inner side wall panel 14*a* is rotated inward approximately 180 degrees about the double crease 22 and the locking tabs 24, 26 (see FIG. 4) are secured in the respective locking slots 28, 30 (see FIG. 4). In this position, the inner surface of the inner side wall panel 14*a* faces the inner surface of the outer side wall panel 14*b* and the minor flaps 18*c*, 20*c* are trapped between the inner and outer side wall panels 14*a*, 14*b*. Similarly, the inner side wall panel 16*a* is rotated inward approximately 180 degrees about the double crease 32 and the locking tabs 34, 36 (see FIG. 4) are secured in the respective locking slots 38, 40 (see FIG. 4). In this position, the inner surface of the inner side wall panel 16*a* faces the inner surface of the outer side wall panel 16*b* and the minor flaps 18*d*, 20*d* are trapped between the inner and outer side wall panels 16*a*, 16*b*.

Sixth, to form the bowed inner panel 18*a* and the convex-shaped ledge 78 of the end wall 18, the inner panel 18*a* is hingedly connected to the outer end wall panel 18*b* by means of a pair of curved score lines 78*a*, 78*b* (FIG. 3). The curvature of the inner score line 78*a* is preferably slightly greater than the curvature of the outer score line 78*b*. To complete the folding sequence and form the container in FIG. 1, the inner panel 18*a* is rotated inward approximately 180 degrees about these curved score lines 78*a*, 78*b* and is secured to the locking slot 88 (FIG. 4) by means of the locking tab 86. In this position, the inner surface of the inner end wall panel 18*a* faces the inner surface of the outer end wall panel 18*b* and the narrow portions 14*c*', 16*c*' of the minor flaps 14*c*, 16*c* are trapped between the inner and outer end wall panels 18*a*, 18*b*. The relatively wide portions of the minor flaps 14*c*, 16*c* remain exposed and serve to provide the end wall 18 with an inner layer at locations to the right and left of the large opening 68 (FIG. 1). This inner layer enhances the structural rigidity and stacking strength of the container 10. It should be apparent that the minor flaps 14*c*, 16*c* are die-cut to conform to the profile of the end wall 18 without obstructing either the small vents 66 or the large opening 68.

Similarly, to form the bowed inner panel 20*a* and the convex-shaped ledge 84 of the end wall 20, the inner panel 20*a* is hingedly connected to the outer end wall panel 20b by means of a pair of curved score lines 84a, 84b (FIG. 3). The curvature of the inner score line 84a is preferably slightly greater than the curvature of the outer score line 84b. The inner panel 20a is rotated inward approximately 180 degrees about these curved score lines 84a, 84b and is secured to the locking slot 92 (FIG. 4) by means of the locking tab 90. In this position, the inner surface of the inner end wall panel 20a faces the inner surface of the outer end wall panel 20b and the narrow portions 14d', 16d' of the minor flaps 14d, 16d are trapped between the inner and outer end wall panels 20a, 20b. The relatively wide portions of the minor flaps 14d, 16d remain exposed and serve to provide the end wall 20 with an inner layer at locations to the right and left of the large opening 72 (FIG. 1). This inner layer enhances the structural rigidity and stacking strength of the container 10. It should be apparent that the minor flaps 14d, 16d are die-cut to conform to the profile of the end wall 20 without obstructing either the small vents 70 or the large opening 72.

The blank 100 in FIG. 3 is designed with various apertures and die-cut portions which cooperate to form the small vents 66, 70. In particular, apertures 66a are formed at the crease between the outer end wall panel 18b and the bottom wall 12, and die-cut portions 66b are formed by the unhinged edge of the inner end wall panel 18a. When the blank 100 is folded to form the container 10, the die-cut portions 66b cooperate with the apertures 66a to form the small vents 66. Similarly, apertures 70a are formed at the crease between the outer end wall panel 20b and the bottom wall 12, and die-cut portions 70b are formed by the unhinged edge of the inner end wall panel 20a. When the blank 100 is folded to form the container 10, the die-cut portions 70b cooperate with the apertures 70a to form the small vents 70.

While the present invention has been described with reference to one or more particular embodiments, those skilled in the art will recognize that many changes may be made thereto without departing from the spirit and scope of the present invention. For example, the curvature of the inner score lines 78a, 84a of the blank 100 in FIG. 3 may be increased or decreased so as to correspondingly increase or decrease the amount by which the inner end wall panels 18a, 20a bow inward toward the interior of the container 10. Each of these embodiments and obvious variations thereof is contemplated as falling within the spirit and scope of the claimed invention, which is set forth in the following claims.

What is claimed is:

1. A stackable berry container, comprising a bottom wall, a pair of opposing side walls, and first and second opposing end walls, each of said first and second end walls forming a respective set of small vents spaced along the lengths of said end walls adjacent said bottom wall, each of said first and second end walls further forming a respective large opening above said respective set of small vents, each of said first and second end walls including a bowed inner panel and an outer panel hingedly connected to each other along a rigid convex-shaped ledge.

2. The container of claim 1, further including a first pair of minor flaps extending from opposing ends of one of said side walls and a second pair of minor flaps extending from opposing ends of the other of said side walls, one of said first pair of flaps and one of said second pair of flaps being captured between said inner and outer panels of said first end wall, the other of said first pair of flaps and the other of said second pair of flaps being captured between said inner and outer panels of said second end wall.

3. The container of claim 2, wherein a lower transverse edge of said inner panel of said first end wall forms a first locking tab and said bottom wall includes a first locking slot, said first locking tab engaging said first locking slot to secure said inner panel of said first end wall to said bottom wall, and wherein a lower transverse edge of said inner panel of said second end wall forms a second locking tab and said bottom wall includes a second locking slot, said second locking tab engaging said second locking slot to secure said inner panel of said second end wall to said bottom wall.

4. The container of claim 2, wherein each of said pair of side walls includes an inner panel and an outer panel hingedly connected to each other along an upper transverse edge, and further including a third pair of minor flaps extending from opposing ends of said first end wall and a fourth pair of minor flaps extending from opposing ends of said second end wall, one of said third pair of flaps and one of said fourth pair of flaps being captured between said inner and outer panels of one of said side walls, the other of said third pair of flaps and the other of said fourth pair of flaps being captured between said inner and outer panels of said other of said side walls.

5. The container of claim 4, wherein a lower transverse edge of said inner panel of said one of said side walls forms a first plurality of locking tabs and said bottom wall includes a first plurality of locking slots, said first plurality of locking tabs engaging said first plurality of locking slots to secure said inner panel of said one of said side walls to said bottom wall, and wherein a lower transverse edge of said inner panel of said other of said side walls forms a second plurality of locking tabs and said bottom wall includes a second plurality of locking slots, said second plurality of locking tabs engaging said second plurality of locking slots to secure said inner panel of said other of said side walls to said bottom wall.

6. The container of claim 1, further including a first plurality of stacking tabs extending upwardly from an upper transverse edge of one of said side walls and a second plurality of stacking tabs extending upwardly from an upper transverse edge of the other of said side walls, and further including first and second pluralities of slots formed in the bottom wall and aligned beneath said respective first and second pluralities of stacking tabs, said first and second pluralities of slots being constructed and arranged to receive stacking tabs of an identical container positioned beneath the stackable berry container.

7. A stackable berry container, comprising a bottom wall, a pair of opposing side walls, and first and second opposing end walls, each of said first and second end walls forming a respective set of small vents spaced along the lengths of said end walls adjacent said bottom wall, each of said first and second end walls further forming a respective large opening above said respective set of small vents, each of said first and second end walls including a bowed inner panel and an outer panel hingedly connected to each other along a rigid convex-shaped ledge, each of said side walls including an inner panel and an outer panel hingedly connected to each other along an upper transverse edge, a first pair of minor flaps extending from opposing ends of said inner panel of one of said side walls and a second pair of minor flaps extending from opposing ends of said inner panel of the other of said side walls, one of said first pair of flaps and one of said second pair of flaps being captured between said inner and outer panels of said first end wall, the other of said first pair of flaps and the other of said second pair of flaps being captured between said inner and outer panels of said second end wall.

8. The container of claim 7, further including a third pair of minor flaps extending from opposing ends of said outer panel of said first end wall and a fourth pair of minor flaps extending from opposing ends of said outer panel of said second end wall, one of said third pair of flaps and one of said fourth pair of flaps being captured between said inner and outer panels of said one of said side walls, the other of said third pair of flaps and the other of said fourth pair of flaps being captured between said inner and outer panels of said other of said side walls.

9. The container of claim 7, wherein a lower transverse edge of said inner panel of said first end wall forms a first locking tab and said bottom wall includes a first locking slot, said first locking tab engaging said first locking slot to secure said inner panel of said first end wall to said bottom wall, and wherein a lower transverse edge of said inner panel of said second end wall forms a second locking tab and said bottom wall includes a second locking slot, said second locking tab engaging said second locking slot to secure said inner panel of said second end wall to said bottom wall.

10. The container of claim 7, wherein a lower transverse edge of said inner panel of said one of said side walls forms a first plurality of locking tabs and said bottom wall includes a first plurality of locking slots, said first plurality of locking tabs engaging said first plurality of locking slots to secure said inner panel of said one of said side walls to said bottom wall, and wherein a lower transverse edge of said inner panel of said other of said side walls forms a second plurality of locking tabs and said bottom wall includes a second plurality of locking slots, said second plurality of locking tabs engaging said second plurality of locking slots to secure said inner panel of said other of said side walls to said bottom wall.

11. The container of claim 7, further including a first plurality of stacking tabs extending upwardly from an upper transverse edge of one of said side walls and a second plurality of stacking tabs extending upwardly from an upper transverse edge of the other of said side walls, and further including first and second pluralities of slots formed in the bottom wall and aligned beneath said respective first and second pluralities of stacking tabs, said first and second pluralities of slots being constructed and arranged to receive stacking tabs of an identical container positioned beneath the stackable berry container.

12. A blank for forming a stackable berry container, comprising a central rectangular panel having a first pair of opposing edges and a second pair of opposing edges, an first outer end wall panel hingedly connected to one of said first pair of opposing edges, a second outer end wall panel hingedly connected to the other of said first pair of opposing edges, a first outer side wall panel hingedly connected to one of said second pair of opposing edges, a second outer side wall panel hingedly connected to the other of said second pair of opposing edges, a first inner end wall panel hingedly connected to said first outer end wall panel along a first pair of curved score lines forming a first convex-shaped panel, and a second inner end wall panel hingedly connected to said second outer end wall panel along a second pair of curved score lines forming a second convex-shaped panel, a first plurality of vents being formed in close proximity to said one of said first pair of opposing edges and a second plurality of vents being formed in close proximity to said other of said first pair of opposing edges.

13. The blank of claim 12, further including a first pair of minor flaps extending from opposing ends of said first outer end wall panel and a second pair of minor flaps extending from opposing ends of said second outer end wall panel.

14. The blank of claim 12, further including a first inner side wall panel hingedly connected to said first outer side wall panel and a second inner side wall panel hingedly connected to said second outer side wall panel, and further including a first pair of minor flaps extending from opposing ends of said first outer side wall panel and a second pair of minor flaps extending from opposing ends of said second outer side wall panel.

* * * * *